US011272796B2

(12) United States Patent
Niasoff

(10) Patent No.: US 11,272,796 B2
(45) Date of Patent: Mar. 15, 2022

(54) MARTIAL ARTS BELT HOLDER

(71) Applicant: Milliard Enterprises Limited Liability Company, Lakewood, NJ (US)

(72) Inventor: Tzippora Niasoff, Lakewood, NJ (US)

(73) Assignee: Milliard Enterprises Limited Liability Company, Lakewood, NJ (US)

( * ) Notice: Subject to any disclaimer, the term of this patent is extended or adjusted under 35 U.S.C. 154(b) by 0 days.

(21) Appl. No.: 17/179,106

(22) Filed: Feb. 18, 2021

(65) Prior Publication Data

US 2021/0251401 A1 Aug. 19, 2021

Related U.S. Application Data

(60) Provisional application No. 62/978,630, filed on Feb. 19, 2020.

(51) Int. Cl.

| | |
|---|---|
| ***A47F 7/19*** | (2006.01) |
| ***A47G 25/74*** | (2006.01) |
| ***A47B 43/00*** | (2006.01) |

(52) U.S. Cl.

CPC ..... *A47F 7/19* (2013.01); *A47B 43/006* (2013.01); *A47G 25/74* (2013.01); *A63B 2244/106* (2013.01)

(58) Field of Classification Search

CPC .. A47F 7/19; A47F 7/12; A47F 5/0006; A47F 5/0892; A63B 2244/106; A47B 43/003; A47B 43/006; A47B 43/04; A47B 43/00; A47G 33/00; A47G 25/74; A47G 25/746; A47G 29/00; A47G 33/004

USPC ..... 211/85.3, 85.29, 113; D6/553, 320

See application file for complete search history.

(56) References Cited

U.S. PATENT DOCUMENTS 1,085,670 A * 2/1914 Cronk ..... B60R 9/06 224/534
1,741,068 A * 12/1929 Newsom ..... A01M 1/2055 239/60
1,853,261 A * 4/1932 Dawson ..... B60R 7/08 211/89.01
1,858,653 A * 5/1932 Willcox ..... A47F 7/175 211/113
3,167,182 A * 1/1965 Calvin ..... A47B 81/005 211/64

(Continued)

OTHER PUBLICATIONS https://www.amazon.com/Milliard-Karate-Belt-Display-Personalize/dp/B07YYNQW3Y/ref=sr_1_12?dchild=1&keywords=karate+belt+holder&qid=1633367414&sr=8-12. Date unknown.*

(Continued)

*Primary Examiner* — Jennifer E. Novosad
(74) *Attorney, Agent, or Firm* — William G. Heedy; The Van Winkle Law Firm

(57) ABSTRACT

A belt holder includes a top section; slats; first straps attached to the slats, a strap of the first straps being configured to at least partially hold a belt to a respective slat of the slats; second straps attached to the slats, a strap of the second straps separating a slat of the slats from an adjacent slat of the slats by a first distance, the first distance being sufficient to allow folding of the slats; and wherein an end of at a first strap of the second straps and an end of a second strap of the second straps are attached to the top section and separate the top section from a topmost slat of the slats by a second distance, the second distance being sufficient to allow folding of the slats with the top section.

7 Claims, 8 Drawing Sheets

(56) References Cited

U.S. PATENT DOCUMENTS 3,294,247 A * 12/1966 Newell ..... A47B 81/005 211/64
3,746,179 A * 7/1973 Paumgardhen ..... A47B 73/00 211/75
4,052,805 A * 10/1977 Potter ..... G09F 1/10 40/124
4,295,432 A * 10/1981 Hulke ..... A47B 43/006 108/149
4,387,873 A * 6/1983 Pavlo ..... A61M 5/1415 211/113
4,441,583 A * 4/1984 Vaught ..... E04G 3/22 182/150
4,523,526 A * 6/1985 O'Neill ..... A47B 43/006 108/149
4,732,378 A * 3/1988 LeFebvre ..... A63B 69/004 482/88
4,749,090 A * 6/1988 Darmanin ..... A47F 5/0892 211/113
5,027,960 A * 7/1991 Rainville ..... B63B 32/80 211/118
D356,003 S * 3/1995 Anderson ..... D6/570
D401,092 S * 11/1998 Patel ..... D6/525
5,950,844 A * 9/1999 Taylor ..... B63B 32/80 211/85.7
6,029,830 A * 2/2000 Manookian ..... A47F 5/083 211/87.01
6,135,334 A * 10/2000 Seichter ..... A45F 3/04 224/250
6,405,909 B1 * 6/2002 Burnett ..... B60R 7/043 211/64
6,637,077 B2 * 10/2003 Doty ..... B60P 3/079 24/298
D499,285 S * 12/2004 Wells ..... D6/514
6,837,385 B2 * 1/2005 Bennett ..... A47B 97/04 211/118
D536,564 S * 2/2007 McGrath ..... D6/570
D537,654 S * 3/2007 Chang ..... D6/682.4
D545,101 S * 6/2007 Chang ..... D6/553
7,988,118 B2 * 8/2011 Shye ..... A47B 73/006 248/318
8,020,712 B2 * 9/2011 Kopp ..... A47F 7/06 211/30
8,534,627 B2 * 9/2013 Kressin ..... F16M 13/02 248/307
8,656,842 B1 * 2/2014 McDonley ..... A47B 23/04 108/42
D758,666 S * 6/2016 Carrillo ..... D28/73
D775,858 S * 1/2017 Holm ..... D6/552
D922,781 S * 6/2021 Niasoff ..... D6/320
2002/0190017 A1 * 12/2002 Stevens ..... A47B 43/006 211/118
2003/0164347 A1 * 9/2003 Bouvier, Jr. ..... B63B 32/80 211/117
2004/0178706 A1 * 9/2004 D'Orso ..... A47B 43/006 312/351
2005/0023229 A1 * 2/2005 Ashley ..... A47B 61/00 211/38
2005/0211645 A1 * 9/2005 Nelson ..... A47F 7/12 211/13.1
2006/0100682 A1 * 5/2006 Koffroth ..... A61F 7/10 607/114
2006/0186071 A1 * 8/2006 Rowan ..... A47B 96/16 211/113
2006/0207952 A1 * 9/2006 Timmons ..... A47G 25/06 211/85.3
2006/0207956 A1 * 9/2006 Sivers ..... A47G 29/00 211/113
2007/0102380 A1 * 5/2007 Shaw ..... A63B 71/0036 211/70.5
2008/0017599 A1 * 1/2008 Springer ..... A47F 7/12 211/85.3
2010/0213150 A1 * 8/2010 Wang ..... A47B 43/006 211/90.01
2013/0032559 A1 * 2/2013 Gregory ..... F16M 13/02 211/113
2014/0165472 A1 * 6/2014 McLemore ..... E06B 3/34 49/381
2017/0086577 A1 * 3/2017 Mahugo-Lopez ... A47B 43/006
2019/0144181 A1 * 5/2019 Fiorella ..... A47F 7/0071 206/460
2021/0251401 A1 * 8/2021 Niasoff ..... A47F 7/19

OTHER PUBLICATIONS https://www.karatemart.com/martial-arts-belt-rack. Date unknown.*
https://www.centurymartialarts.com/industrial-belt-display-13032. Date unknown.*
https://www.alibaba.com/product-detail/10-Level-wooden-free-combination-foldable_62238357886.html. Date unknown.*
https://www.instructables.com/Karate-Belt-Hanging-Display/. Date Unknown.*

* cited by examiner

MARTIAL ARTS BELT HOLDER

RELATED APPLICATION

This application claims priority to and incorporates entirely by reference U.S. Provisional Patent Application Ser. No. 62/978,630 filed on Feb. 19, 2020.

BACKGROUND

As part of a colored belt system, individuals who participate in martial arts often obtain a newly colored belt to serve as a visual symbol of the participant's progress and ranking in their area of martial arts. Such participants are often desirous of displaying the belts collectively in an aesthetic manner.

A belt holder, such as for, but not limited to, a Karate belt, is disclosed.

SUMMARY

In accordance with one form of the invention, there is provided a belt holder including a top section; a plurality of slats; a plurality of first straps attached to the plurality of slats, a strap of the plurality of first straps configured to at least partially hold a belt to a respective slat of the plurality of slats; a plurality of second straps attached to the plurality of slats, a strap of the plurality of second straps separating a slat of the plurality of slats from an adjacent slat of the plurality of slats by a first distance, the first distance being sufficient to allow folding of the plurality of slats; and wherein an end of at a first strap of the plurality of second straps and an end of a second strap of the plurality of second straps are attached to the top section and separate the top section from a topmost slat of the plurality of slats by a second distance, the second distance being sufficient to allow folding of the plurality of slats with the top section; and wherein the second distance may be the same as, or different from, the first distance.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION

Figure 1:
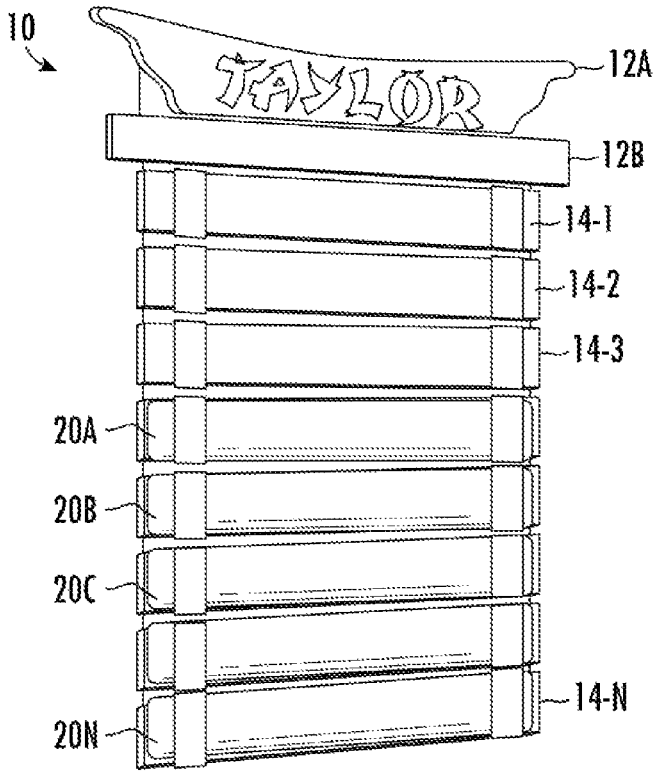
FIG. 1 shows the belt holder in an unfurled or display configuration.

FIG. 1 shows the belt holder 10 in an unfurled or display configuration wherein it may be hung on a wall, rack, or other support to provide for an aesthetic and prominent display of the belts 20 (20A-20N) earned by the user. The belt holder 10 has a top section 12 (12A, 12B) and a plurality of slats 14 (14-1-14-N) which may hold, for example, one or more belts 20, such as, but not limited to, Karate belts.

Figure 5:
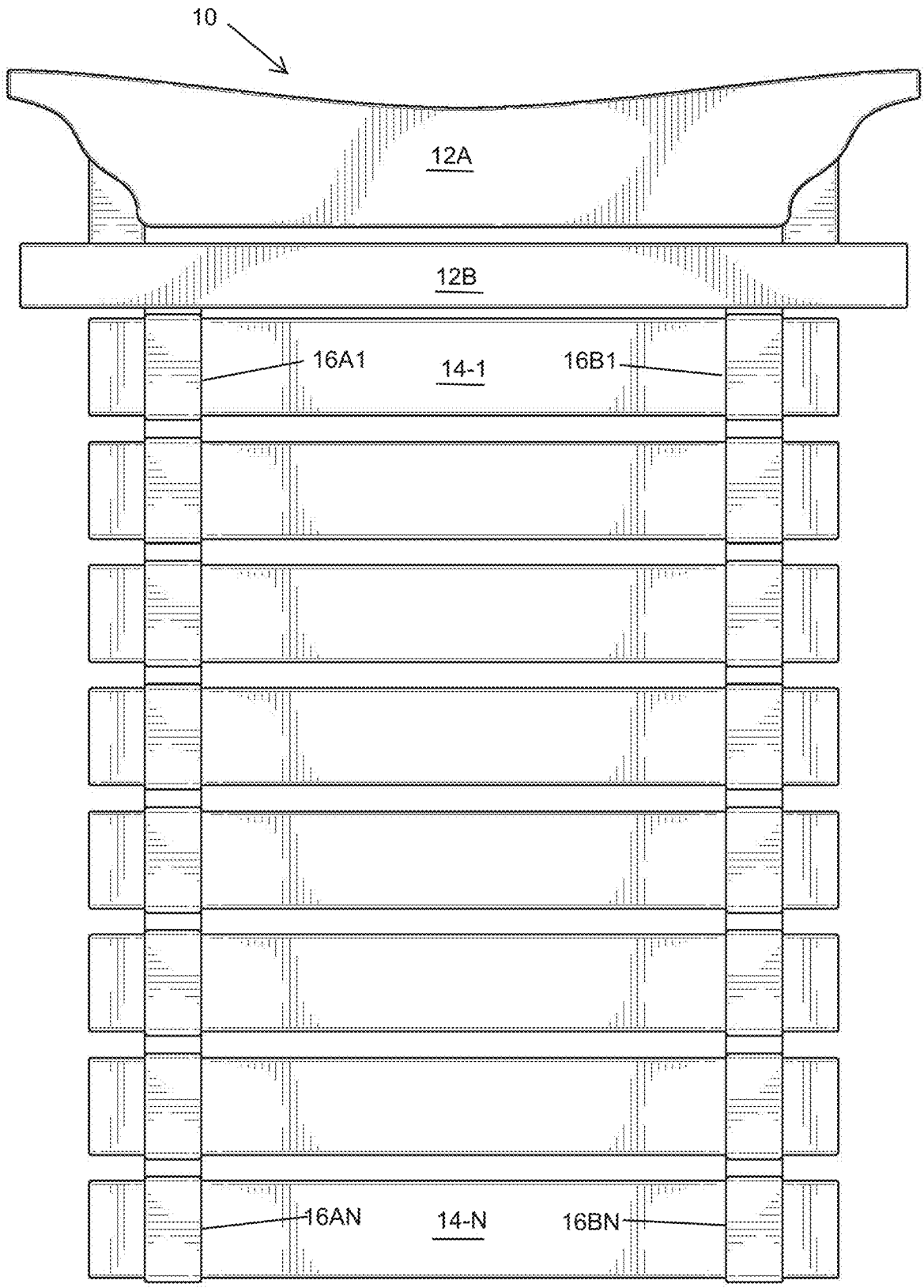
FIG. 5 is a front view of the belt holder.
Figure 6:
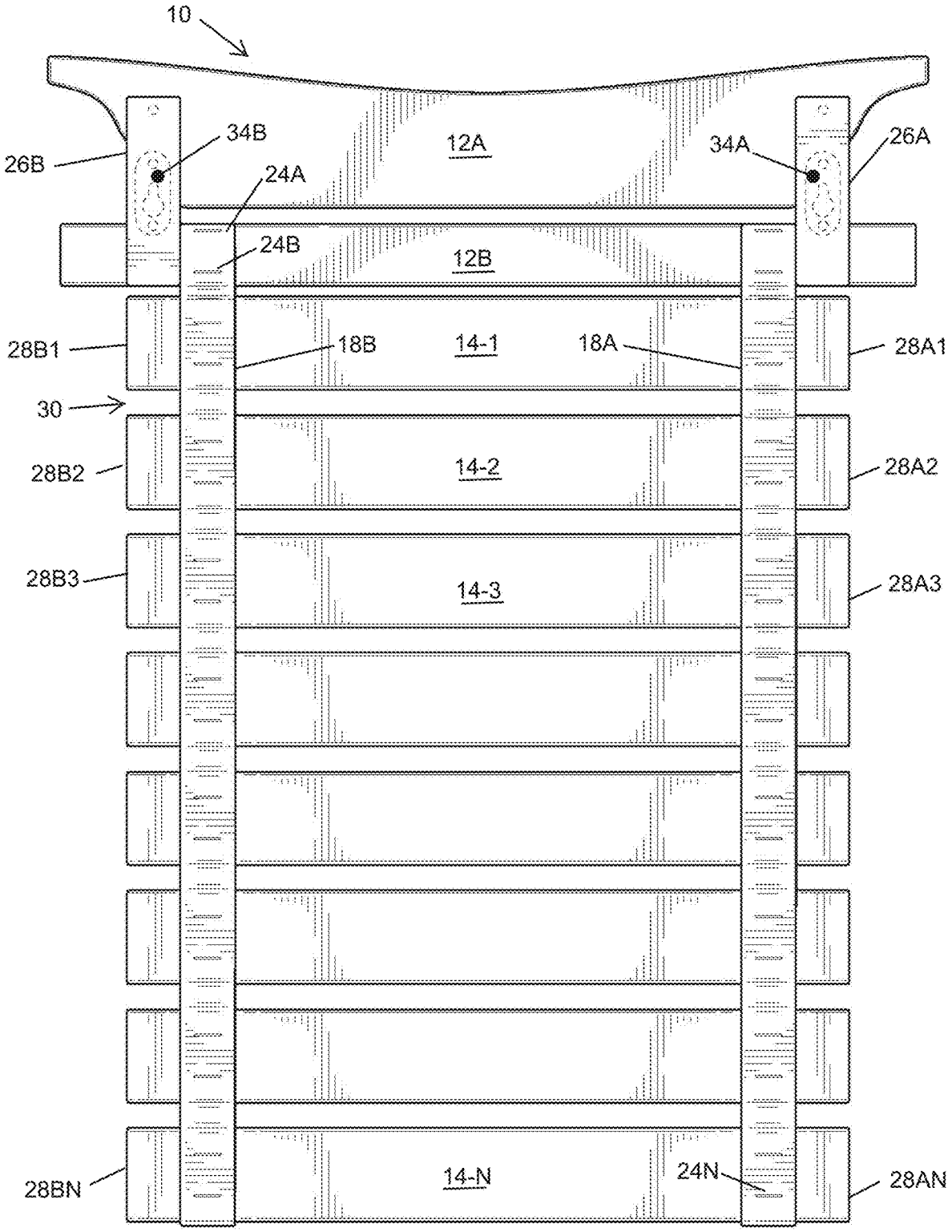
FIG. 6 is a rear view of the belt holder.
Figure 7:
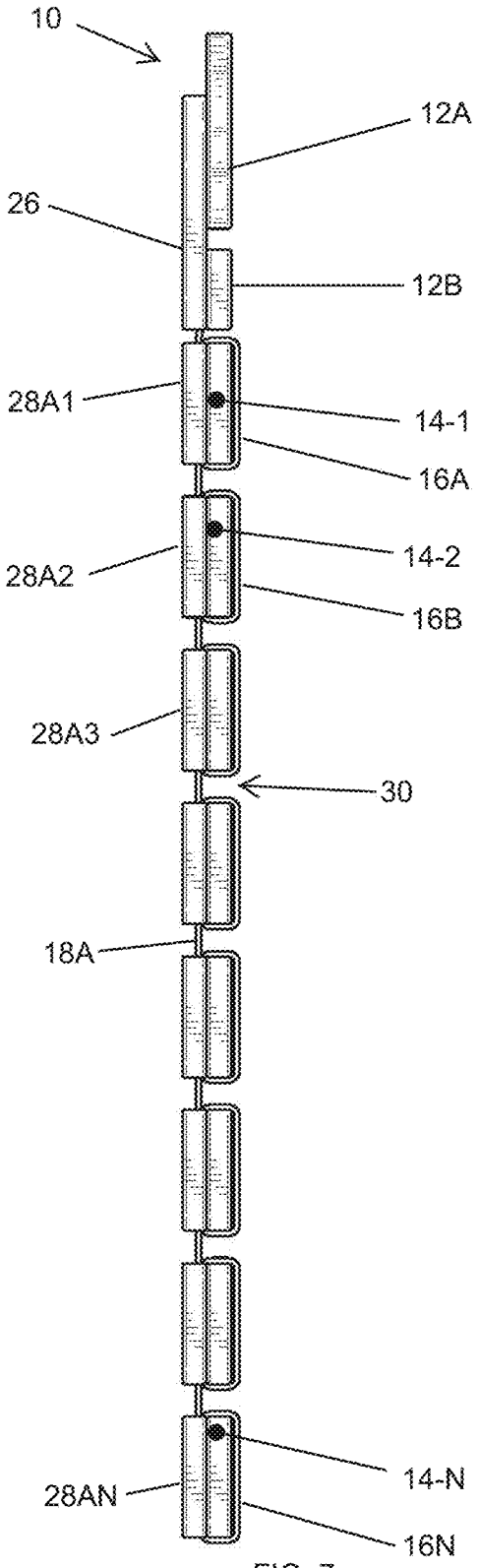
FIG. 7 is left side view of the belt holder.

The top section 12 preferably comprises two sections, 12A, 12B. The section 12A is preferably stylistic and preferably displays the name or other information about the user. The section 12B is preferably left blank but may be used, if desired, to display other information and/or an aesthetic rendering. Alternatively, the top section 12 may be a single section, such as just section 12A, or just section 12B. In another embodiment the top section 12 may have three or more sections. The construction of the top section 12 is best seen in FIGS. 5-7. The top section 12 may be plain if desired.

Figure 2:
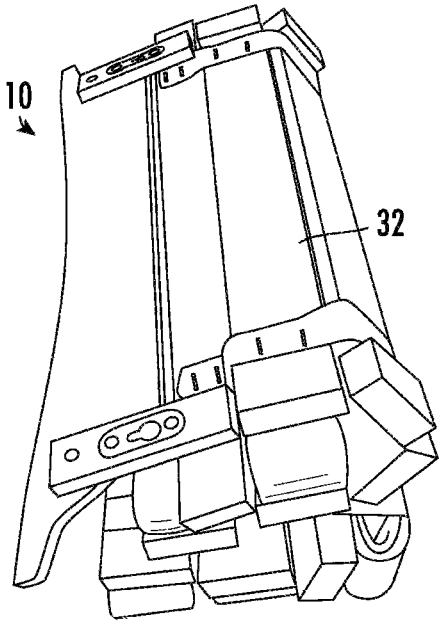
FIG. 2 shows the belt holder in a rolled up or coiled configuration.

FIG. 2 shows the belt holder 10 in a rolled up or coiled configuration. This configuration provides for convenient shipping, carrying, or other transportation.

Figure 3:
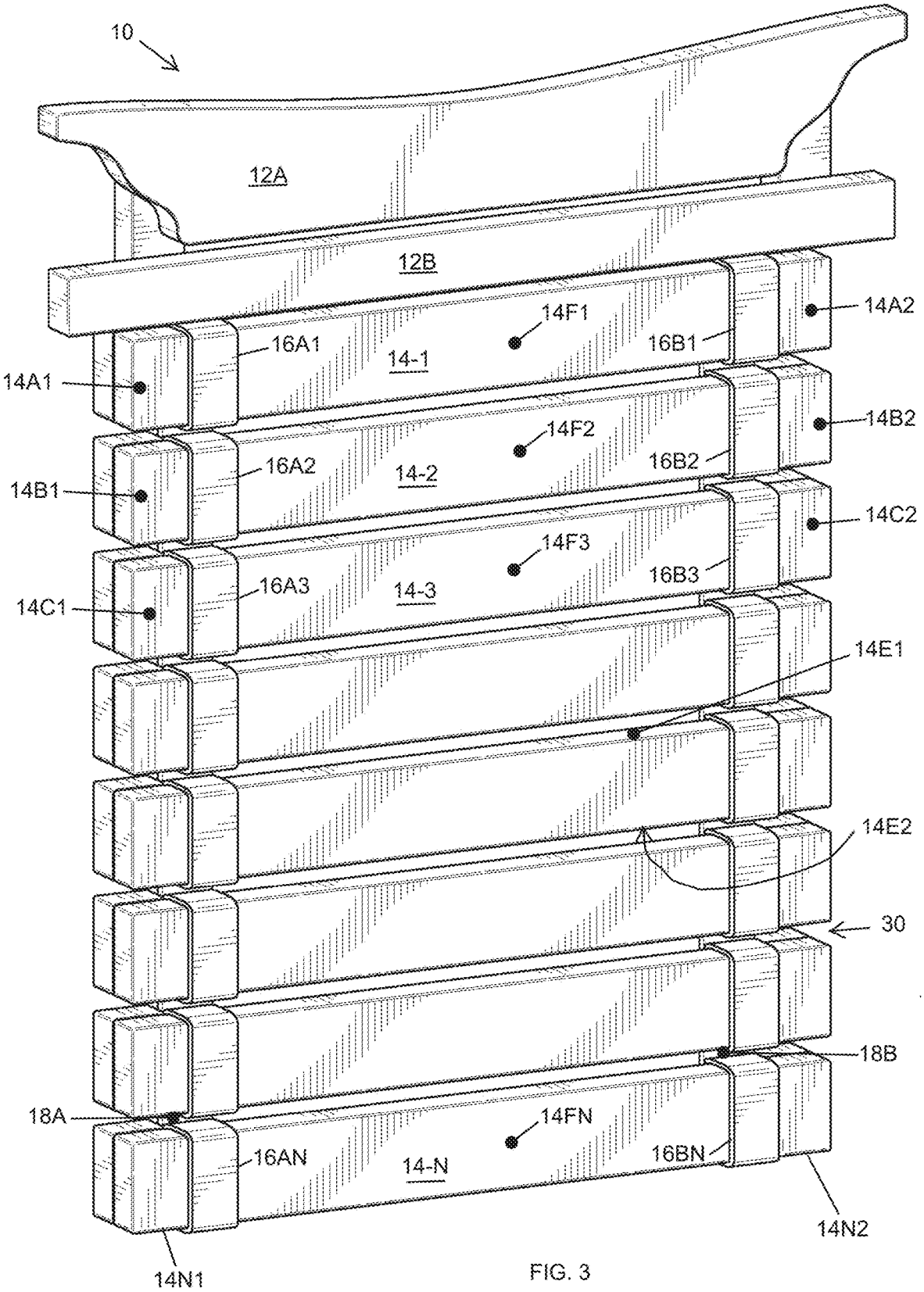
FIG. 3 is a perspective view of the belt holder.

FIG. 3 is a perspective view of the belt holder 10 showing a plurality of first straps 16 (16A: 16A1-16AN; 16B: 16B1-16BN) and a plurality of second straps 18 (18A, 18B) (best seen in FIGS. 6, 7, 9, 10). The first straps 16 hold the belts 20 to the slats 14. The second straps 18 hold the slats 14 to each other and also to the top section 12.

The straps 16 hold the belts 20 to the front side 14F (14F1-14FN) of a slat 14, and the straps 18 provide for flexibility to allow the belt holder 10 to be conveniently rolled up (FIG. 2) and unrolled (FIG. 1). In one embodiment, the straps 16 are formed from an elastomeric material in order to provide for flexibility to allow the belt holder 10 to be conveniently rolled up (FIG. 2) and unrolled (FIG. 1).

The first straps 16A1-16AN, 16B1-16BN are attached to the slats 14A-14N, respectively. The straps 16A1-16AN, 16B1-16BN are preferably attached near or at the ends 14A1-14N1, 14A2-14N2, respectively, of the slat 14.

Figure 9:
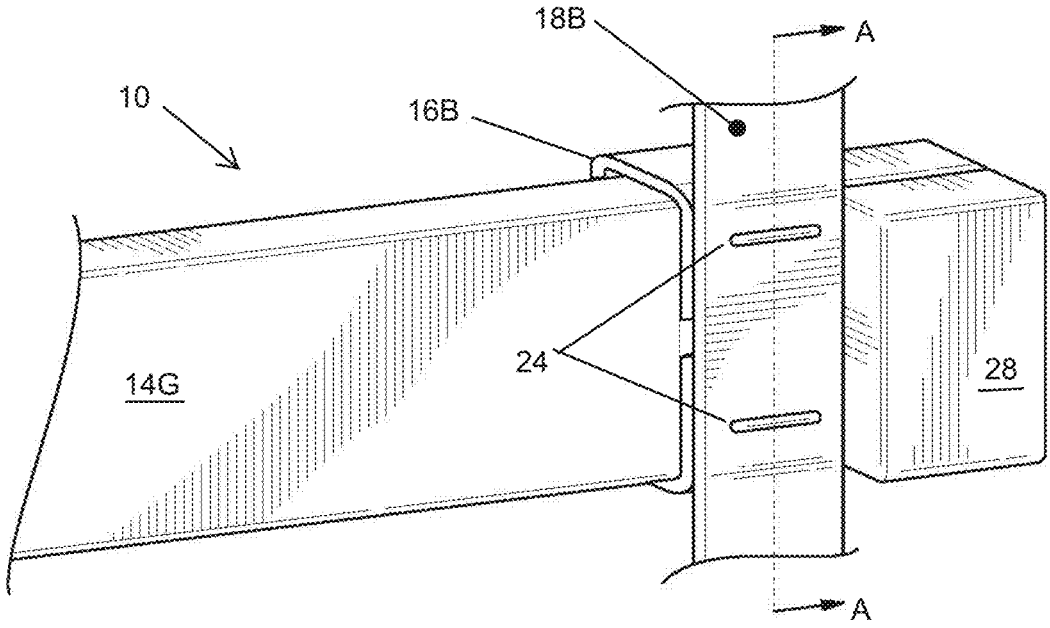
FIG. 9 is a rear view of a portion of the belt holder.
Figure 10:
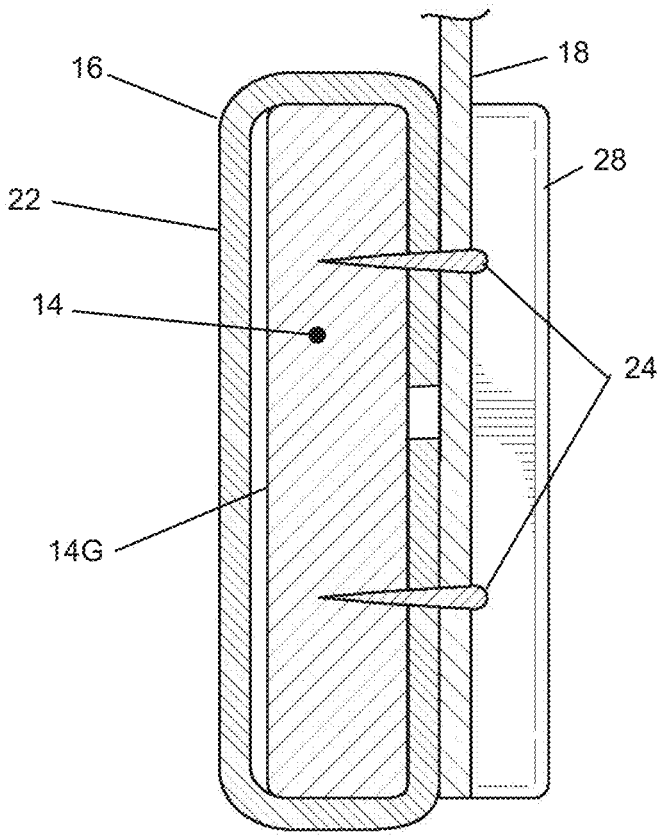
FIG. 10 is a side view of the belt holder along line A-A of FIG. 9.

A strap 16 forms a loop 22 (FIG. 10). A strap 16 is preferably made of an elastomeric material that can stretch to accommodate and snugly hold a belt 20. Alternatively, the strap 16 may be made of a non-elastomeric material, with the loop 22 being large enough to accommodate a belt 20 while still being small enough to snugly hold the belt 20. A strap 16 is preferably attached to the back side 14G (14G1-14GN) of a slat 14 (best seen in FIGS. 6, 9, 10), Alternatively (FIG. 3), the straps may be attached to the top and bottom edges 14E (14E1, 14E2), of a slat 14, or may be attached to the front side 14F (14F1-14FN) of the slats 14. A strap 16 may be attached to a slat 14 by staples, glue, tacks, or another convenient or desirable method.

The slats 14 are also attached to the second straps 18. There are at least two second straps 18 but there may be three or more, if desired. The second straps 18 are preferably, but not necessarily, attached to the slats 14 at the same location as the straps 16, that is, near or at the ends 14A, 14B of the slat 14. The second straps 18 may, however, be attached to the slats 14 at a different location than the straps 16.

The second straps 18 separate the slats 14 from each other by a spacing distance 30 (FIGS. 3, 6) sufficient to allow folding of the slats 14, such as by rolling up the belt holder 10 to form a compact, somewhat cylindrical package 32 as shown in FIG. 2. Alternatively, the slats 14 may be folded one atop the other so as to form a stack (not shown).

In one embodiment, each second strap 18 has a length sufficient to extend from the top section 12 to the bottom-most slat 14 while providing the spacing distance 30. In another embodiment a second strap 18 is long enough to allow attachment of the second strap 18 to one slat 14 and to an adjacent slat 14, while still separating the slats 14 from each other by the spacing distance 30.

Figure 4:
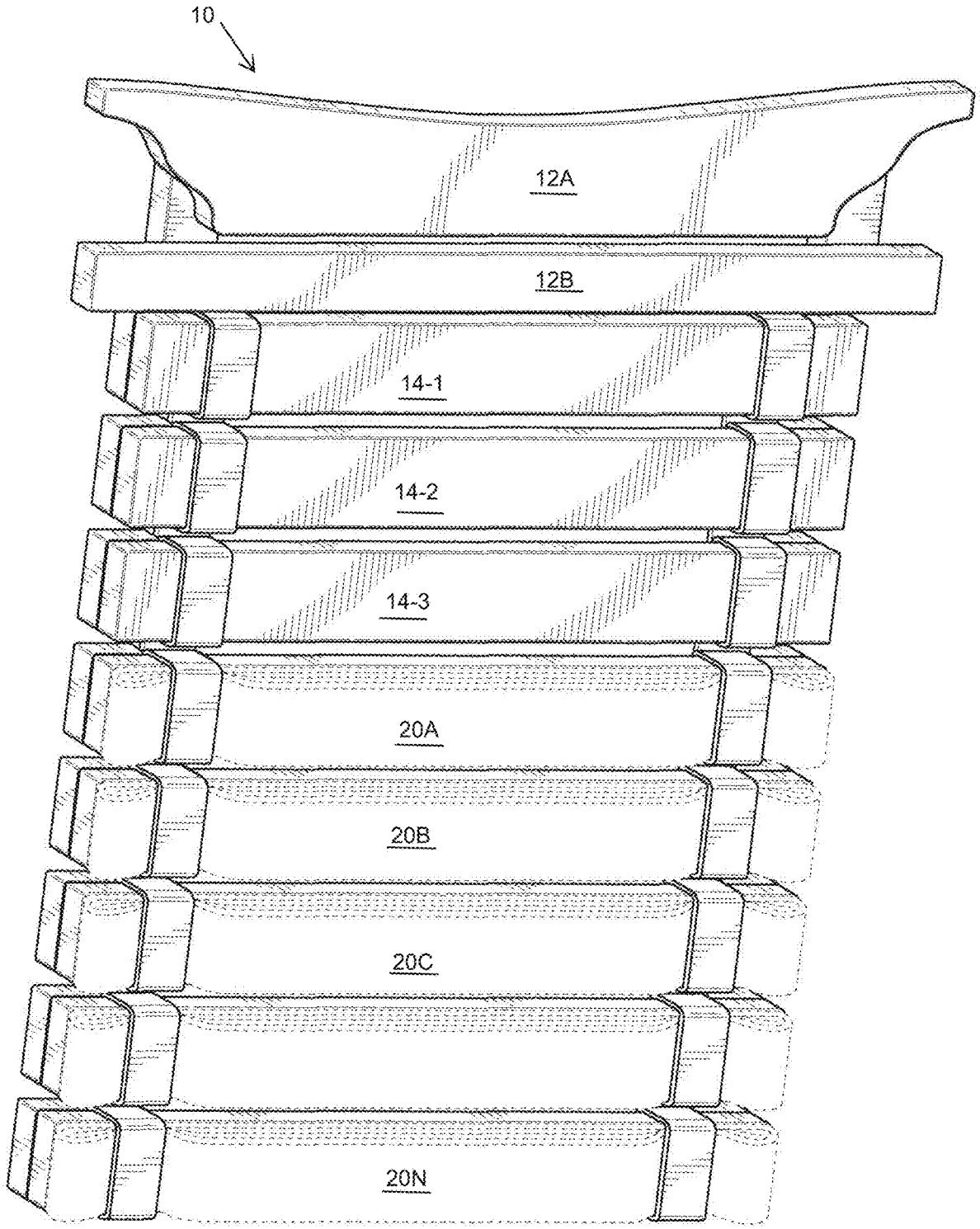
FIG. 4 is a perspective view of the belt holder with belts held thereon.

FIG. 4 is a perspective view of the belt holder 10 with belts 20A-20N (shown by dashed lines in this FIG.) held thereon. A belt 20 is inserted under, and is held in place by, two of the first straps 16 on a slat 14.

FIG. 5 is a front view of the belt holder 10 showing the top section 12A, 12B, the slats 14A-14N, and the first straps 16A1-16AN, 16B1-16BN.

FIG. 6 is a rear view of the belt holder 10 and shows staples 24 (24A-24N), columns 26 (26A, 26B), and edge spacers 28 (28A: 28A1-28AN; 28B:28B1-28BN) (best seen in FIG. 7). In an embodiment, the first straps 16 and the second straps 18 are held to the slats 14 by staples 24 (24A-24N). As mentioned above, the straps 16, 18 may be held to the slats 14 by glue, tacks, or another convenient or desirable method.

The straps 18 are also held to the top section 12B by staples, glue, tacks, or another convenient or desirable method. The top section 12A and the top section 12B are connected to the columns 26 by nails, screws, staples, glue, tacks, or another convenient or desirable method. The columns 26 preferably have hangers 34 (34A, 34B) which allows the belt holder 10 to be hung on a vertical surface, such as a wall, by nails or screws. The hangers 34 are preferably recessed to allow the belt holder 10, when mounted on a wall or lying on a flat surface, to have a flush appearance with the wall or surface.

FIG. 7 is left side view of the belt holder 10. The columns 26, without more, would cause the top section 12 to project forward of the slats 14 when the belt holder 10 is mounted on a wall or lying on a flat surface. The edge spacers 28 compensate for the columns 26 and allow the belt holder 10, when mounted on a wall or lying on a flat surface, to have a flush appearance with the wall or surface.

Figure 8:
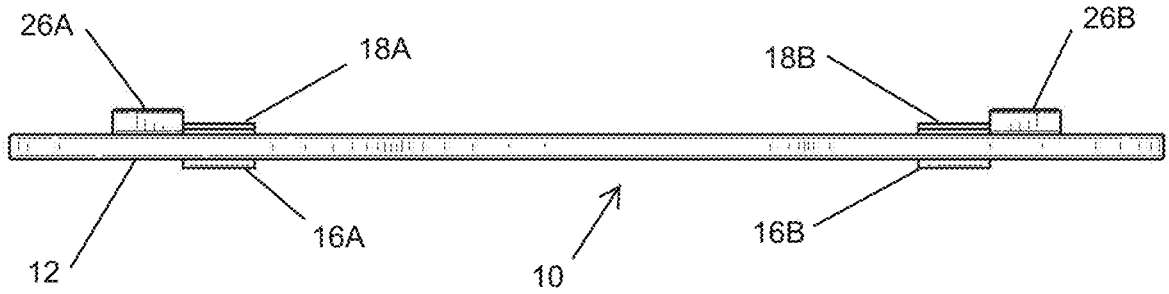
FIG. 8 is a top view of the belt holder.

FIG. 8 is a top view of the belt holder 10.

FIG. 9 is a rear view of a portion of the belt holder 10 showing a first strap 16B, a second strap 18B, staples 24, and an edge spacer 28.

FIG. 10 is a side view of the belt holder 10 along line A-A of FIG. 9.

Unless otherwise defined, all terms (including technical and scientific terms used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The term "exemplary" is used herein to mean serving as an example, instance, or illustration. Any aspect or design described herein as "exemplary" is not necessarily to be construed as preferred or advantageous over other aspects or designs. Similarly, examples are provided herein solely for purposes of clarity and understanding and are not meant to limit the subject innovation or portion thereof in any manner.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments are contemplated, described herein, and set forth in the claims.

For convenience of discussion herein, when there is more than one of a component, that component may be referred to herein either collectively or singularly by the singular reference numeral unless expressly stated otherwise or the context clearly indicates otherwise. For example, components N (plural) or component N (singular) may be used unless a specific component is intended. Also, the singular forms "a," "an," and "the" are intended to include the plural forms as well, unless expressly stated otherwise or the context indicates otherwise.

It will be further understood that the terms "includes," "comprises," "including," and/or "comprising" specify the presence of stated features, steps, operations, elements, and/or components, but do not preclude the presence or addition of one or more other features, steps, operations, elements, components, and/or groups thereof unless explicitly stated otherwise or the context clearly requires otherwise. The terms "includes," "has" or "having" or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled or coupled by one or more intervening components unless expressly stated otherwise or the context clearly indicates otherwise.

The term "and/or" includes any and all combinations of one or more of the associated listed items. As used herein, phrases such as "between X and Y" and "between about X and Y" should be interpreted to include X and Y unless expressly stated otherwise or the context clearly indicates otherwise.

Terms such as "about", "approximately", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While the terms vertical, horizontal, upper, lower, bottom, top, and the like may be used herein, it is to be understood that these terms are used for ease in referencing the drawing and, unless otherwise indicated or required by context, does not denote a required orientation.

The different advantages and benefits disclosed and/or provided by the implementation(s) disclosed herein may be used individually or in combination with one, some or possibly even all of the other benefits. Furthermore, not every implementation, nor every component of an implementation, is necessarily required to obtain, or necessarily required to provide, one or more of the advantages and benefits of the implementation.

Conditional language, such as, among others, "can", "could", "might", or "may", unless specifically stated otherwise, or otherwise understood within the context as used, is generally intended to convey that certain embodiments preferably or optionally include certain features, elements and/or steps, while some other embodiments optionally do not include those certain features, elements and/or steps. Thus, such conditional language indicates, in general, that those features, elements and/or step may not be required for every implementation or embodiment.

The subject matter described herein is provided by way of illustration only and should not be construed as limiting the nature and scope of the subject invention. While examples of aspects of the subject invention have been provided above, it is not possible to describe every conceivable combination of components or methodologies for implementing the subject invention, and one of ordinary skill in the art may recognize that further combinations and permutations of the subject invention are possible. Furthermore, the subject invention is not necessarily limited to implementations that solve any or all disadvantages which may have been noted in any part of this disclosure. Various modifications and changes may be made to the subject invention described herein without following, or departing from the spirit and scope of, the exemplary embodiments and applications illustrated and described herein. Although the subject matter presented herein has been described in language specific to components used therein, it is to be understood that the subject invention is not necessarily limited to the specific components or characteristics thereof described herein; rather, the specific components and characteristics thereof are disclosed as example forms of implementing the subject invention. Accordingly, the disclosed subject matter is intended to embrace all alterations, modifications, and variations, that fall within the scope and spirit of any claims that are written, or may be written, for the subject invention.

What is claimed is:

1. A martial arts belt holder comprising:

a top section;

a plurality of slats, each slat of the plurality of slats being elongate and having a height corresponding to the width of a martial arts belt, each slat of the plurality of slats having a front side and a back side;

a plurality of pairs of first straps, wherein each slat of the plurality of slats has at least one pair of the plurality of pairs of first straps attached thereto, the at least one pair of the plurality of pairs of first straps configured to at least partially hold a martial arts belt to the front side of a respective slat of the plurality of slats;

a pair of second straps attached to the plurality of slats, the pair of second straps separating a slat of the plurality of slats from an adjacent slat of the plurality of slats by a first distance, the first distance being sufficient to allow rolling and unrolling of the plurality of slats with respect to each other; and wherein an end of a first strap of the pair of second straps and an end of a second strap of the pair of second straps are attached to the top section and separate the top section from a topmost slat of the plurality of slats by a second distance, the second distance being sufficient to allow rolling and unrolling of the plurality of slats with respect to the top section;

wherein the second distance may be the same as, or different from, the first distance; and wherein a martial arts belt, folded and attached to a respective slat by a respective pair of first straps, lies flush against a majority of the front side of the respective slat.

2. The martial arts belt holder as recited in claim 1 wherein the top section comprises a first section and a second section.

3. The martial arts belt holder as recited in claim 1 wherein at least one of the pairs of the plurality of first straps is formed from an elastomeric material.

4. The martial arts belt holder as recited in claim 1 wherein at least one pair of the plurality of pairs of first straps is formed from a non-elastomeric material.

5. The martial arts belt holder as recited in claim 1 further comprising a plurality of edge spacers attached to the plurality of slats, a pair of edge spacers being attached near opposing ends of the back side of a respective slat of the plurality of slats.

6. The martial arts belt holder as recited in claim 1, wherein the top section has a front side and a back side, and further comprising first and second columns attached near opposing ends of the back side of the top section; and first and second hangers attached to the first and second columns, respectively, for attachment of the belt holder to a vertical surface.

7. The martial arts belt holder as recited in claim 6 wherein each of the first and second hangers are recessed in the first and second columns, respectively, to allow the belt holder to have a flush appearance with the vertical surface when the belt holder is attached to the vertical surface.

* * * * *